United States Patent [19]

Shibata

[11] Patent Number: 5,037,340

[45] Date of Patent: Aug. 6, 1991

[54] LUBRICATING DEVICE FOR FOUR STROKE OUTBOARD MOTOR

[75] Inventor: Tasuhiko Shibata, Hamamatsu, Japan

[73] Assignee: Sanshi Kogyo Kabushiki Kaisha, Hamamatsu, Japan

[21] Appl. No.: 501,272

[22] Filed: Mar. 29, 1990

[30] Foreign Application Priority Data

Mar. 29, 1989 [JP] Japan ..... 1-77862

[51] Int. Cl.[5] ..... B63H 21/10; B63H 21/38

[52] U.S. Cl. ..... 440/88; 123/196 R; 440/900

[58] Field of Search ..... 440/61, 75, 83, 88, 440/89, 900; 123/195 R, 196 R, 196 W; 184/1.5, 6.6, 6.18

[56] References Cited

U.S. PATENT DOCUMENTS 4,588,385 5/1986 Suzuki et al. ..... 440/88
4,692,123 9/1987 Tada et al. ..... 440/77
4,735,590 4/1988 Mondek ..... 440/88

FOREIGN PATENT DOCUMENTS 0261797 12/1985 Japan ..... 440/88

OTHER PUBLICATIONS pp. 530 & 531 of Internal Combustion Engines and Air Pollution by Edward F. Obert, 1973.

*Primary Examiner*—Ed Swinehart
*Attorney, Agent, or Firm*—Ernest A. Beutler

[57] ABSTRACT

A number of embodiments of outboard motors powered by four cycle internal combustion engines having a dry sump lubrication system wherein the external oil reservoir is positioned externally of the engine. In some embodiments, the reservoir is contained directly in the power head and in another embodiment, the reservoir is contained externally of the outboard motor. The use of such external positioning of the lubricant reservoirs from the drive shaft housing permits the use of a large expansion chamber for the exhaust system in the drive shaft housing. In one embodiment, a pair of expansion chambers are provided therein.

19 Claims, 9 Drawing Sheets

LUBRICATING DEVICE FOR FOUR STROKE OUTBOARD MOTOR

BACKGROUND OF THE INVENTION

This invention relates to a lubricating device for a four stroke outboard motor and more particularly to an improved lubricant system for such an outboard motor.

It has been proposed to employ four cycle engines as the power plant for an outboard motor. Although two cycle engines are normally employed for this purpose because of their simplicity and high power output to displacement, there are some instances when it may be desirable to employ a four cycle engine as the power plant in an outboard motor. However, a four cycle engine requires a closed lubricating system that includes a lubricant reservoir and an arrangement for circulating the lubricant through the engine for its lubrication and then returning it to the lubricant reservoir. Also, it is desirable to provide some form of strainer or filter assembly for the lubricant. Due to the compact nature of an outboard motor, it has been relatively difficult to provide an adequate lubricant supply for a four cycle powered outboard motor. This is primarily due to the fact that outboard motors frequently are run for long periods of time at full throttle and, therefore, it is desirable if not essential to provide a relatively large lubricant capacity.

It has been proposed to provide a lubricant reservoir for an outboard motor having a four cycle engine in which the lubricant reservoir depends into and is contained primarily within the drive shaft housing. Although such an arrangement will permit the use of a large lubricant reservoir, normally it is the practice to provide a large expansion chamber for silencing the exhaust gases also in the drive shaft housing. Therefore, as the size of the lubricant reservoir is increased, the possible size of the expansion chamber for the exhaust system is decreased.

It is, therefore, a principal object of this invention to provide an improved arrangement wherein an outboard motor may be powered by a four cycle internal combustion engine having a large lubricant reservoir and wherein the lubricant reservoir does not depend into the drive shaft housing to any significant extent.

It is a further object of this invention to provide an improved four cycle powered outboard motor having a dry sump lubrication system wherein the dry sump is positioned externally of the engine and of the drive shaft housing and lower unit

SUMMARY OF THE INVENTION

This invention is adapted to be embodied in an outboard motor that is comprised of a power head that includes an internal combustion engine and a surrounding protective cowling. A drive shaft housing and lower unit depend from the power head and are affixed thereto. A drive shaft driven by the internal combustion engine is journaled in the drive shaft housing and lower unit and drives a propulsion unit therein. In accordance with the invention, the internal combustion engine operates on a four stroke cycle and has a lubricating system, a lubricant reservoir external of the engine and of the drive shaft housing and lower unit and means for circulating lubricant between the lubricant reservoir and the engine lubricating system.

DETAILED DESCRIPTION OF THE PREFERRED EMBODIMENTS OF THE INVENTION

Figure 1:
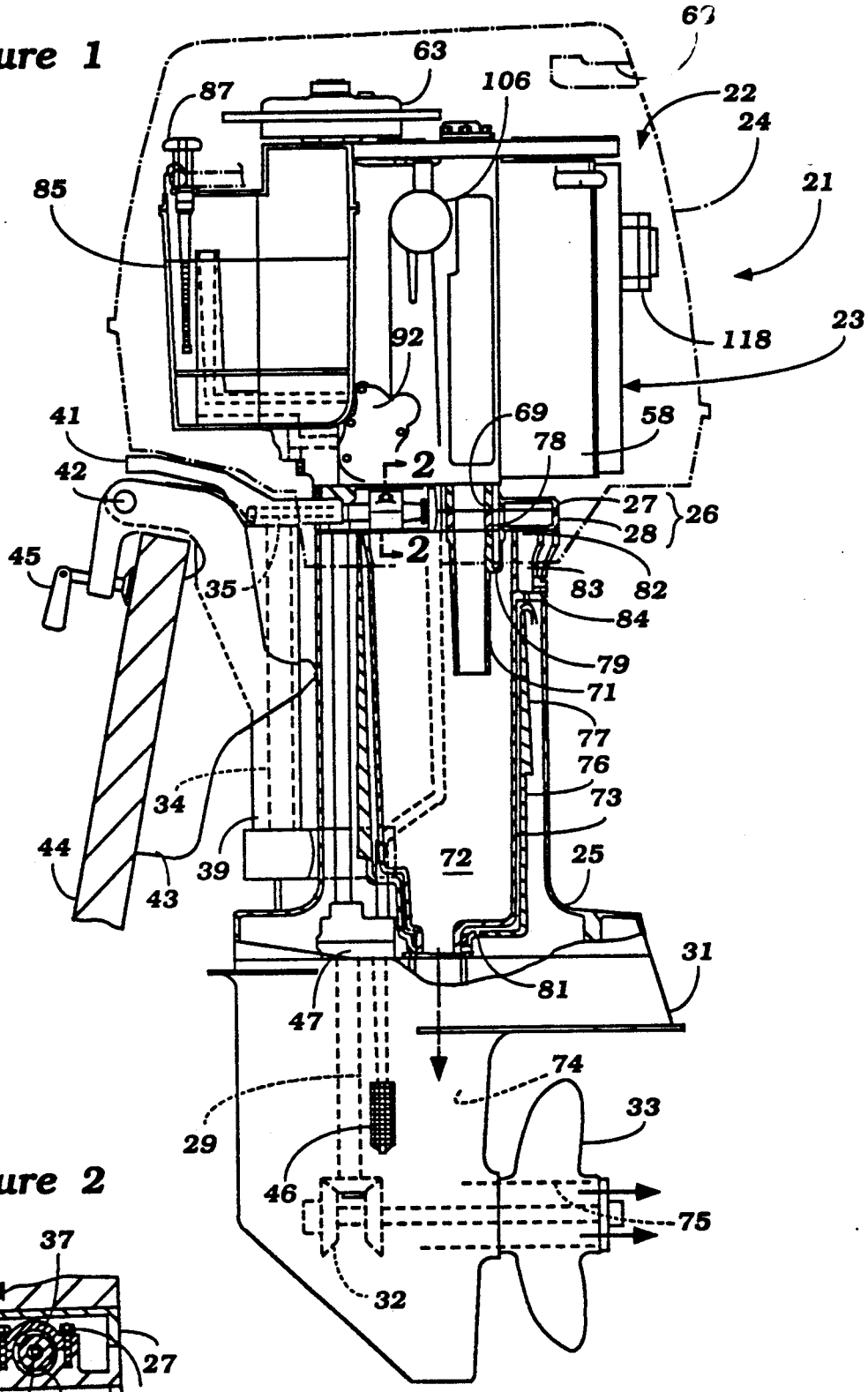
FIG. 1 is a side elevational view of an outboard motor constructed in accordance with a first embodiment of the invention as attached to the transom of an associated watercraft with portions broken away and other portions shown in section.

Referring first to the embodiment of FIGS. 1 through 9 and initially primarily to FIG. 1, an outboard motor constructed in accordance with this embodiment is identified generally by the reference numeral 21. The outboard motor 21 includes a power head, indicated generally by the reference numeral 22 and which consists primarily of an internal combustion engine 23 which, in the illustrated embodiment, is of the four cylinder in line type and operates on a four stroke cycle, and a surrounding protective cowling 24 which may be of any suitable type. The engine 23, as has been noted, is of the four cylinder in line type, but it is to be understood that the invention can be utilized in conjunction with engines having other numbers of cylinders and other cylinder configurations or, for that matter, with rotary engines.

A drive shaft housing 25 depends from the power head 22 and is affixed to the engine 23 by means of a spacer plate assembly 26 that is comprised of an upper plate 27 and a lower plate 28. A drive shaft 29 is coupled to the engine output shaft and is journaled within the drive shaft housing 25. This drive shaft 29 depends into a lower unit 31 that is connected to the drive shaft housing 25 in a suitable manner and which contains a forward, neutral, reverse transmission 32 driven by the drive shaft 29 for selectively driving a propeller 33 in forward or reverse directions.

Figure 2:
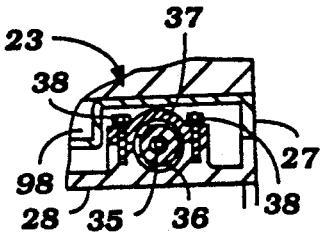
FIG. 2 is a cross sectional view taken along the line 2—2 of FIG. 1.

A steering shaft 34 is affixed to the drive shaft housing 25 by means including a pair of bolts 35 that extend into the upper spacer plate assembly 26 and which are resiliently clamped therein by means of an elastic sleeve 36 that is held in place by a saddle clamp 37 and bolts 38 (FIG. 2). The lower end of the steering shaft 34 may be affixed to the drive shaft housing 25 in a suitable manner. The steering shaft 34 is journaled for steering movement within a swivel bracket assembly 39. A tiller 41 is affixed in a suitable manner to the upper end of the steering shaft 34 and the spacer plate 26 so as to steer the outboard motor 21, in a manner well known in this art.

The swivel bracket 39 is pivotally connected by means of a pivot pin 42 to a clamping bracket 43. This pivotal connection permits tilt and trim movement of the outboard motor 21 relative to a transom 44 of an associated watercraft to which it is fixed by means of a clamping assembly 45 carried by the clamping bracket 43.

The engine 23 is water cooled. The cooling system includes a water inlet 46 that is disposed in the lower unit 31 at a location where it will be submerged during normal phases of engine operation. A water pump 47 is driven by the drive shaft 29 and is contained at the junction between the drive shaft housing 25 and the lower unit 31. Water is circulated through the engine cooling jacket by the water pump 47 in a known manner and this water is returned to the body of water in which the watercraft is operating by a return which includes returns for cooling portions of the exhaust system, as will be noted.

Figure 3:
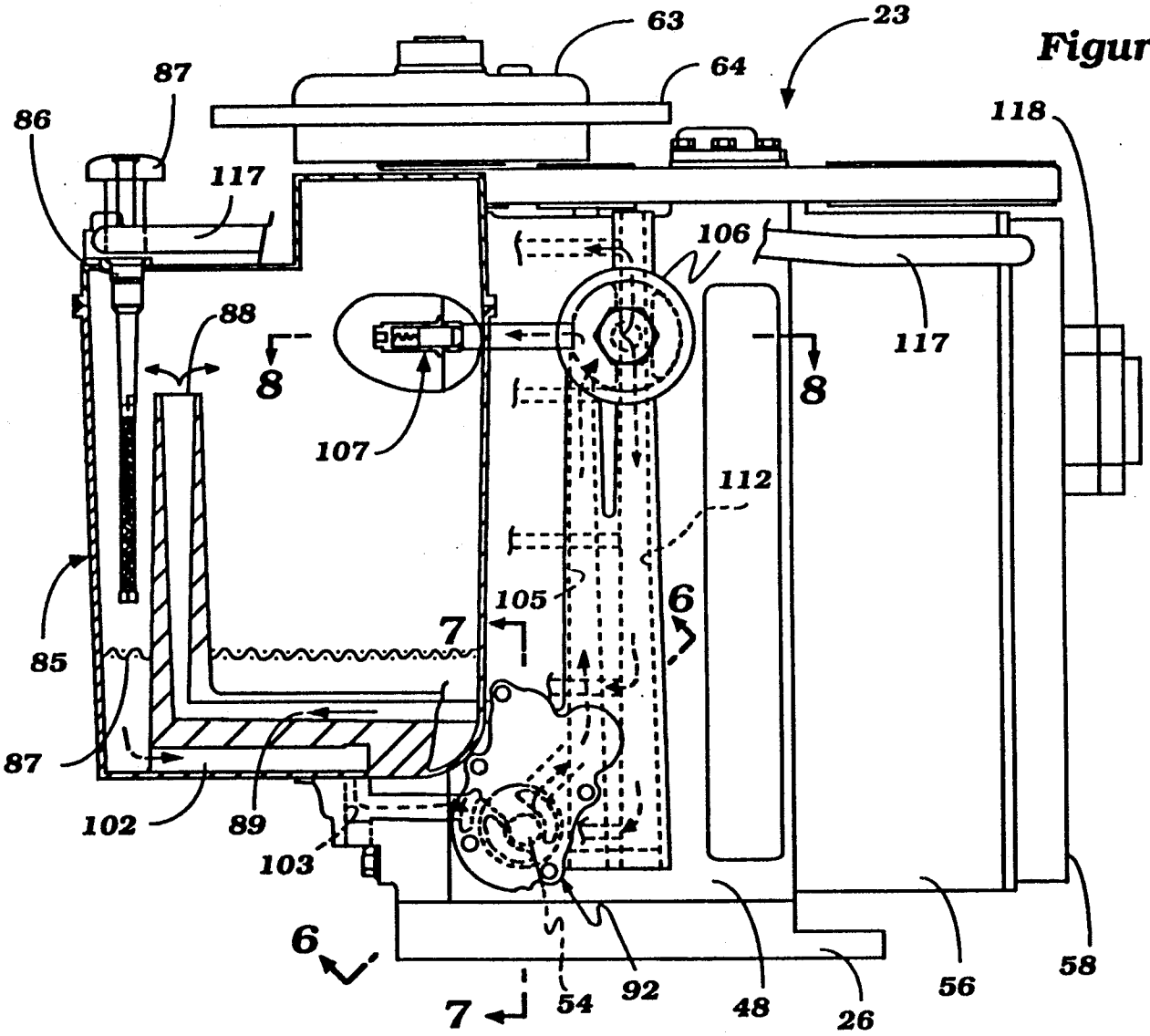
FIG. 3 is an enlarged side elevational view of the internal combustion engine and its oil reservoir, with portions broken away and shown in section.
Figure 4:
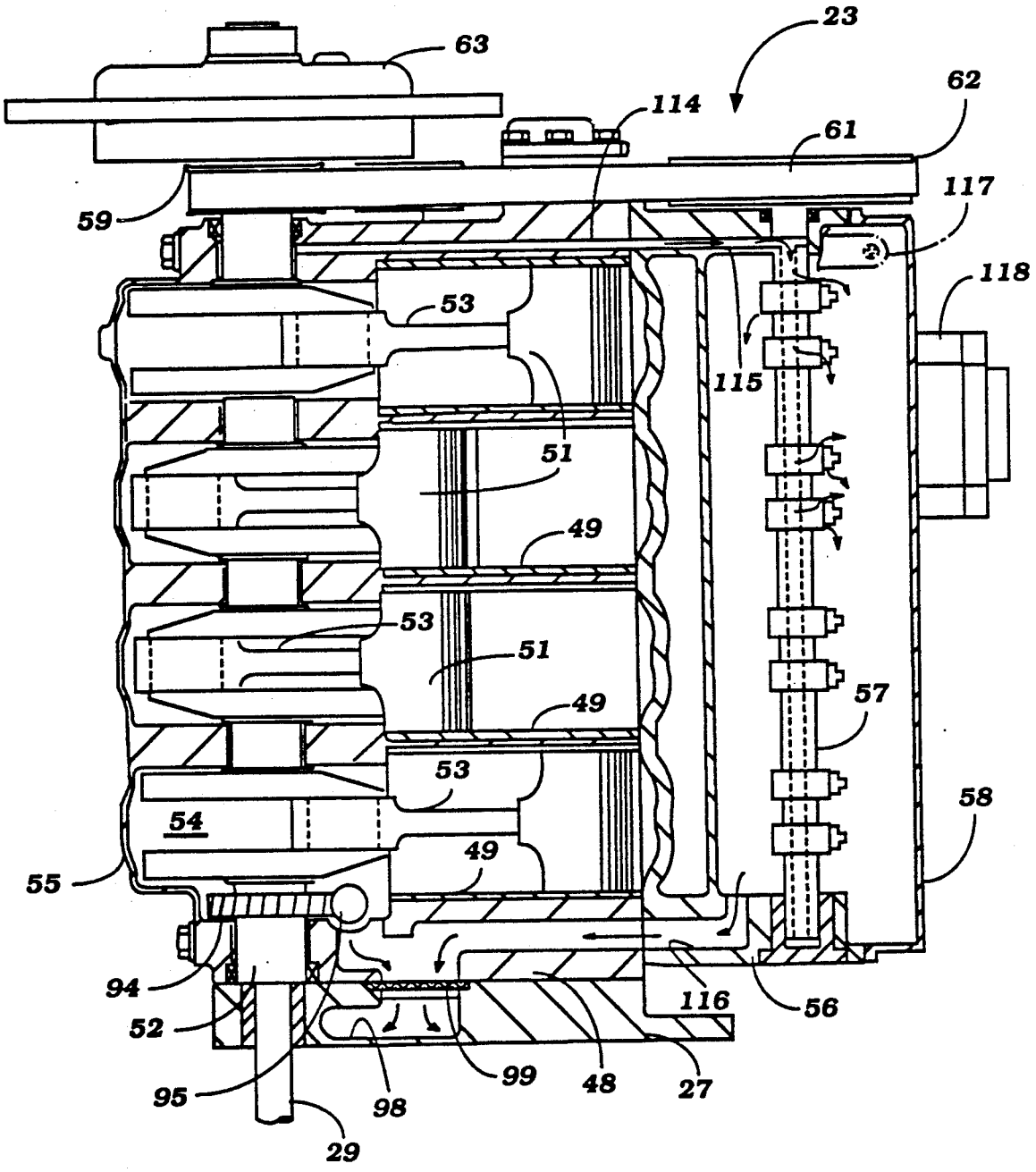
FIG. 4 is a cross sectional view taken through the cylinder bores of the engine.
Figure 5:
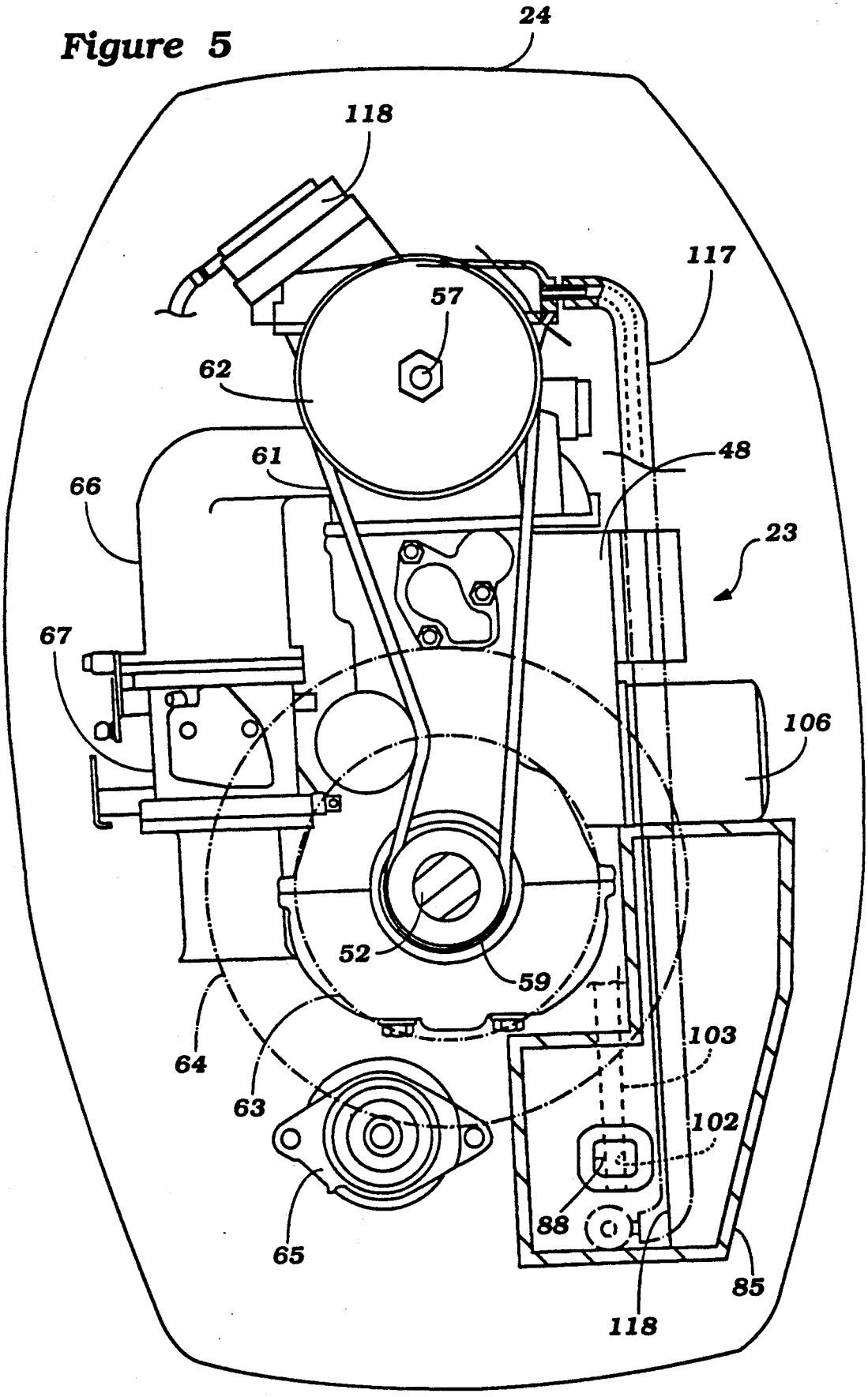
FIG. 5 is a top plan view of the engine and shows the outline of the protective cowling.

Referring now additionally primarily to FIGS. 3 through 5, the engine 23 includes a cylinder block 48 in which four horizontally disposed cylinder bores 49 are formed. As is conventional with outboard motor practice, the cylinder bores 49 are disposed in a horizontal plane so that the pistons 51 which reciprocate in them will drive the associated crankshaft 52 for rotation about a vertically extending axis through their connection therewith by connecting rods 53. The crankshaft 52 is connected to the drive shaft 29 in a suitable manner as by means of a coupling (not shown). The crankshaft 52 is journaled for rotation by suitable bearings and is contained within a crankcase chamber 54 that is formed by the lower portion of the cylinder block 48 and a crank pan 55 that is affixed to the cylinder block 48 in a known manner.

A cylinder head 56 is affixed to the cylinder block 48 in a known manner and contains a plurality of intake and exhaust valves (not shown) that control the flow of intake charge into the cylinders 49 and exhaust charge therefrom. These valves are operated by one or more overhead camshafts 57 that are journaled in the cylinder head assembly 56 in a known manner. A cam cover 58 encloses the camshaft chamber of the engine.

It should be noted that a sprocket 59 is affixed to the crankshaft 52 immediately above the cylinder block 48 and drives a belt 61 which, in turn, drives a toothed sprocket 62 that is affixed to the camshaft 57 for driving it at one half of crankshaft speed, as is well known in this art.

A flywheel magneto assembly 63 is affixed to the upper end of the crankshaft 52 above the sprocket 59 and provides the electrical power for firing the spark plugs of the engine in a known manner. Basically, the internal components of the engine, except for the lubricating system, form no part of the invention. For that reason, the basic construction of the engine has not been illustrated in any more detail than is necessary so as to permit those skilled in the art to understand the invention and the way it is practiced.

The flywheel magneto assembly 63 may have affixed to it a starter gear 64 that can be driven by an electrical starting motor 65 for ease of starting of the engine 23. The engine 23 further includes an induction system including an intake manifold 66 that receives a fuel/air charge from one or more carburetors 67 for delivery to the engine combustion chambers through the intake valves in a known manner. The carburetors 67 draw air from within the protective cowling 24 which may enter through an external air inlet 68 (FIG. 1) formed in the top portion of the cowling 24 in a known manner.

The burnt combustion gases from the combustion chambers are discharged from an exhaust manifold (not shown) into an exhaust inlet opening 69 formed in the upper piece 27 of the spacer plate 26. This exhaust inlet opening 69 cooperates with an exhaust pipe 71 formed by the lower plate 28 and which depends into an expansion chamber 72 formed by an inner shell 73 contained within the drive shaft housing 25. The expansion of the gases from the exhaust pipe 71 into the expansion chamber 72 will effectively silence them. These exhaust gases are then discharged through an exhaust passage 74 formed in the lower unit 23 and which communicates with a through the hub exhaust 75 of a known type.

A water jacket 76 is formed around the expansion chamber 72 by means of a portion 77 of the drive shaft housing 25. In a similar manner, a water jacket 78 is formed by the spacer plate 26 around the exhaust inlet 69 and the upper portion of the exhaust pipe 71. Water is delivered from the engine to these two cooling jackets in a known manner. The water from the cooling jackets 78 may pass through a small weep hole 79 so as to contact the outer surface of the exhaust pipe 71 and cool it. This water will also assist in silencing the exhaust gases and will be returned to the body of water in which the watercraft is operating through the hub exhaust 75.

In a like manner, a weep hole 79 is formed at the lower end of the water chamber 76 so as to permit water to drain therefrom when the engine is not running. In addition, water can overflow the top of the wall 77 that defines the outer periphery of the water chamber 76 and be discharged back into the body of water in which the watercraft is operating.

It should be noted that, because of the dry sump lubrication system to be described, the expansion chamber 72 may substantially fill the drive shaft housing 25. This permits good exhaust tuning without interference from any components of the lubricating system of the engine.

There is also provided an above the water low speed exhaust gas discharge for discharging the exhaust gases that cannot pass through the through the hub exhaust gas discharge 75 when the motor 21 is operating at low speeds due to the high degree of submersion. This exhaust gas passage includes a small hole 82 that extends through the spacer plate 26 at the upper portion of the expansion chamber 72 and which communicates with an expansion chamber 83 formed in the drive shaft housing 25 and which has an above the water exhaust gas discharge 84. The restriction of this system is such that very little exhaust gases will flow therethrough when the outboard motor 21 is operating at high speeds and the through the hub exhaust 75 is only shallowly submerged.

As has been noted, the expansion chamber 72 may be quite large due to the fact that lubrication system has no reservoir that extends into the drive shaft housing 25.

This lubrication system will now be described by particular reference to FIG. 1 and FIGS. 3 through 9.

This lubrication system includes an external dry sump oil reservoir 85 which, in this embodiment, is mounted externally of the engine 23 but within the power head 22. By externally of the engine, it is meant that the lubricant reservoir 85 is not formed by any of the main castings or components of the engine nor is the reservoir formed internally of the engine. Because of the use of this external reservoir, it is possible to maintain an adequate volume of lubricant for the engine 23 even though it runs at high speeds for long periods of time without, as has been previously noted, encroaching in the drive shaft housing 25.

The reservoir 85 may be conveniently formed from a lightweight metal such as sheet metal or an aluminum alloy and is, in this illustrated embodiment, disposed adjacent the crankcase 55 of the engine and has a generally L shaped configuration in top plan view as shown in FIG. 5. Of course, other configurations can readily be employed and, as will be noted hereinafter, other locations are also possible. Lubricant may be added to the oil reservoir 85 through a suitable fill opening, for example an opening 86 that is closed by a combined closure and dipstick 87. There may also be provided a drain passage (not shown) in the lower portion of the oil reservoir 85 so that it may be drained for servicing. Adjacent the lower end of the reservoir 85 there is provided a transversely extending screen 87 which serves to prevent foreign particles of large size and any entrained air from passing through the lubricating system back to the engine.

A stand pipe 88 is formed in the lower portion of the oil reservoir 85 and has a passageway 89 that communicates with the return outlet of a scavenge pump 91 which forms a part of a pump assembly 92. A light check valve 93 is provided between the outlet of the scavenge pump 91 and the conduit 89 so as to prevent any reverse flow. Because the stand pipe 88 extends above the normal oil level in the reservoir 85, return oil will be discharged back down into the reservoir along the sides of the stand pipe 88 so as to assist in air separation from the return lubricant and also to insure minimizing of frothing and the inclusion of air in the oil reservoir 85.

Figure 6:
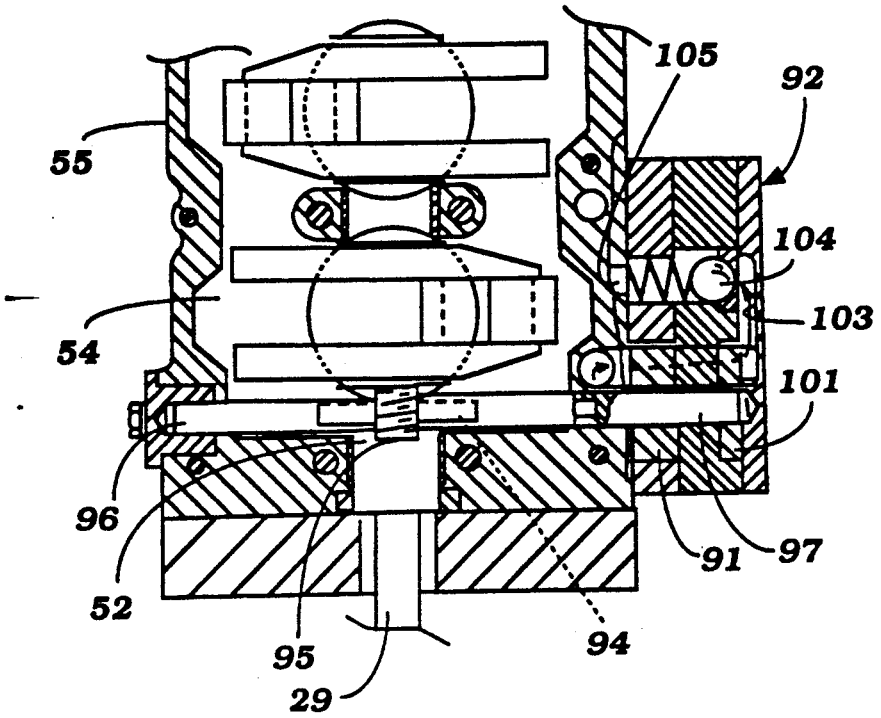
FIG. 6 is an enlarged cross sectional view taken along the line 6—6 of FIG. 3.
Figure 7:
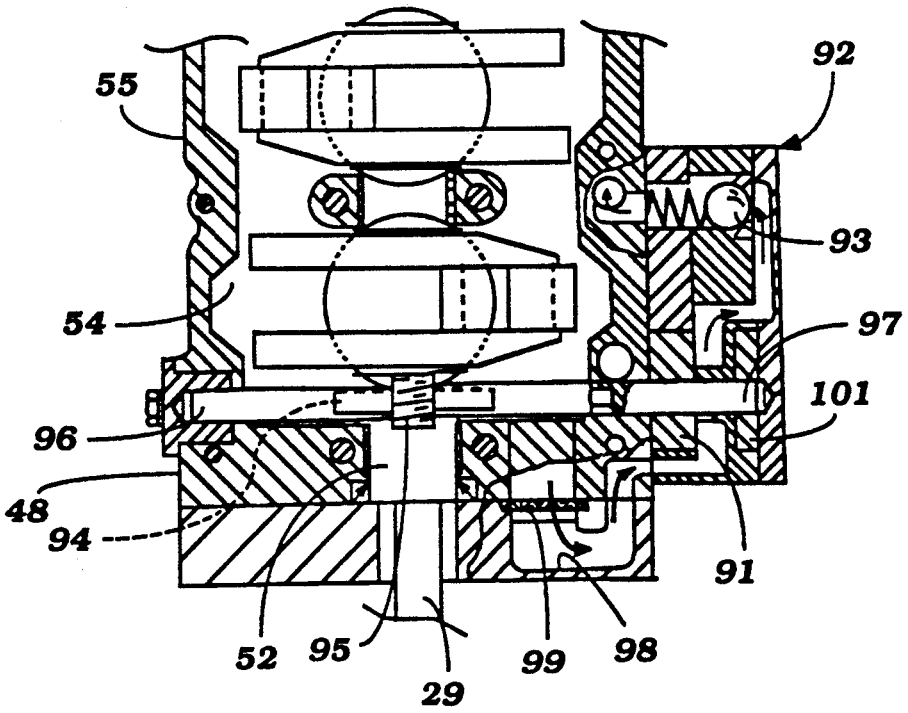
FIG. 7 is an enlarged cross sectional view taken along the line 7—7 of FIG. 3.
Figure 8:
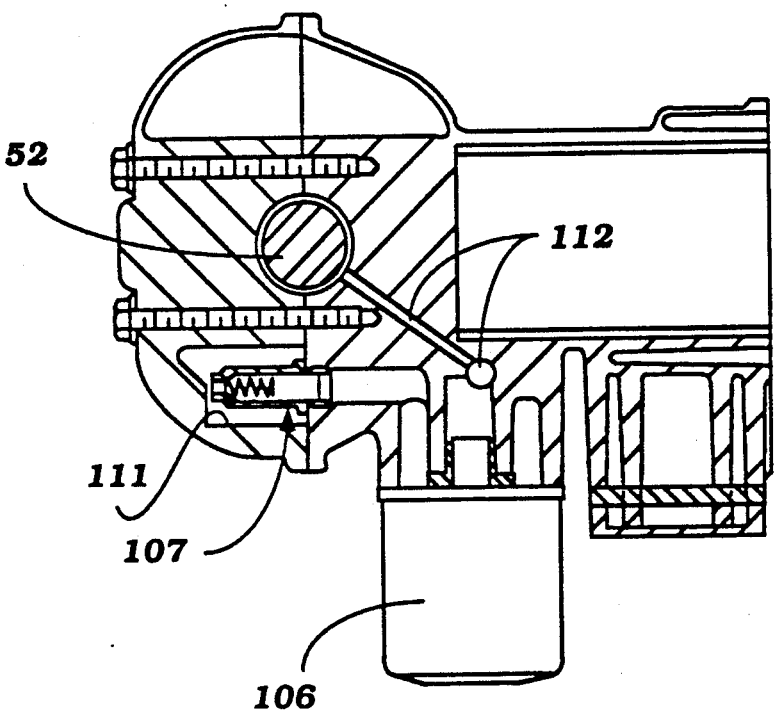
FIG. 8 is a cross sectional view taken along the line 8—8 of FIG. 3.
Figure 9:
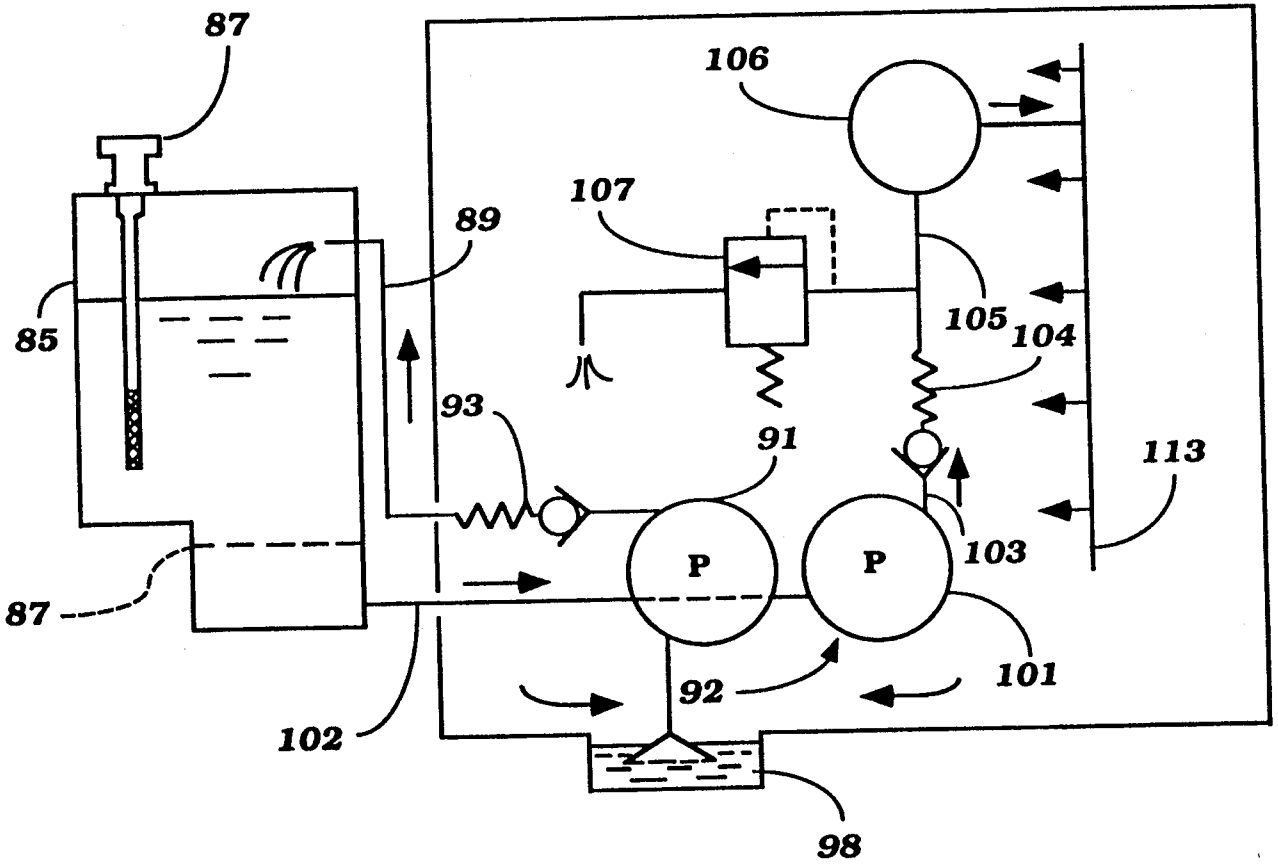
FIG. 9 is a schematic view of the lubricating system of this embodiment.

As may best be seen in FIGS. 4, 6 and 7, the pump assembly 92 is driven off of the lower end of the crankshaft 52 by means of a worm gear 94 that is affixed to or formed integrally with the crankshaft 92 and which engages a worm wheel 95 which is, in turn, affixed to or integrally connected to a pump drive shaft 96 that is journaled in the crankcase 95 and cylinder block 48. This shaft has a splined connection to a further shaft 97 of the pump assembly 92 that is journaled in its outer housing. The scavenge pump 91 is of the tricodal type and draws lubricant which has been drained from the engine into a well 98 formed by the spacer plate assembly 26 and specifically by its upper plate 27. A filter screen 99 is positioned between this plate 27 and the cylinder block 48 for removing large particles from the drained oil. The oil is then returned to the lubricant tank 85 through the path previously described.

The pump assembly 92 further includes a pressure pump which is also of the tricodal type and which is indicated by the reference numeral 101. As previously noted, the pump 101 is also driven from the shaft 97. Lubricant is delivered to the pressure pump 101 through a conduit 102 that is formed in the lower portion of the stand pipe 88 and a passageway 103 formed in the cylinder block 48 (FIGS. 3 and 5). This lubricant then is delivered through a passageway 103 formed in the pump assembly to a light check valve 104. The check valve 104 discharges into a vertically extending passageway 105 formed in the cylinder block and which communicates with the inlet side of an oil filter 106 that is mounted appropriately on the side of the cylinder block assembly for ease of servicing. A pressure relief valve 107 (FIGS. 8 and 9) also communicates with the pump inlet and maintains a maximum pressure in the pressure side of the oil delivery system. This pressure is relieved through a port 111 which drains back into the engine return system and eventually communicates with the well 98.

The outlet side of the oil filter 106 communicates with a main oil gallery 112 which, in turn, delivers lubricant to a cylinder block passageway 113 that delivers lubricant in a known manner to the main bearings of the crankshaft 52. In addition, the main oil gallery 112 communicates with a cross drilled passageway 114 (FIG. 4) which, in turn, communicates with a further passageway 115 formed in the cylinder head for delivering lubricant to the camshaft 57 for its lubrication. The lubricant may flow through the main bearings of the camshaft and also the cam lobes and is returned through a drain passageway 116 that also delivers the return oil to the well 98.

The engine lubricating system thus far described is provided with a vent pipe 117 that interconnects the upper end of the camshaft chamber and crankshaft chambers with the upper portion of the oil reservoir 85 for minimizing pressure differences. It should be noted that the vent passage 117 is not only above the normal oil level in the system when the outboard motor 21 is in its upright position, but is also above the oil level line 118 as shown in FIG. 5 when the outboard motor 21 is laid on its side. This will prevent lubricant from flowing back from the reservoir into the lubricant system. The check valves 93 and 104 also serve this purpose. The engine may also be provided with a fuel pump 118 that is driven from the camshaft 57 in an appropriate manner for delivering fuel to the carburetor or carburetors 67.

Figure 10:
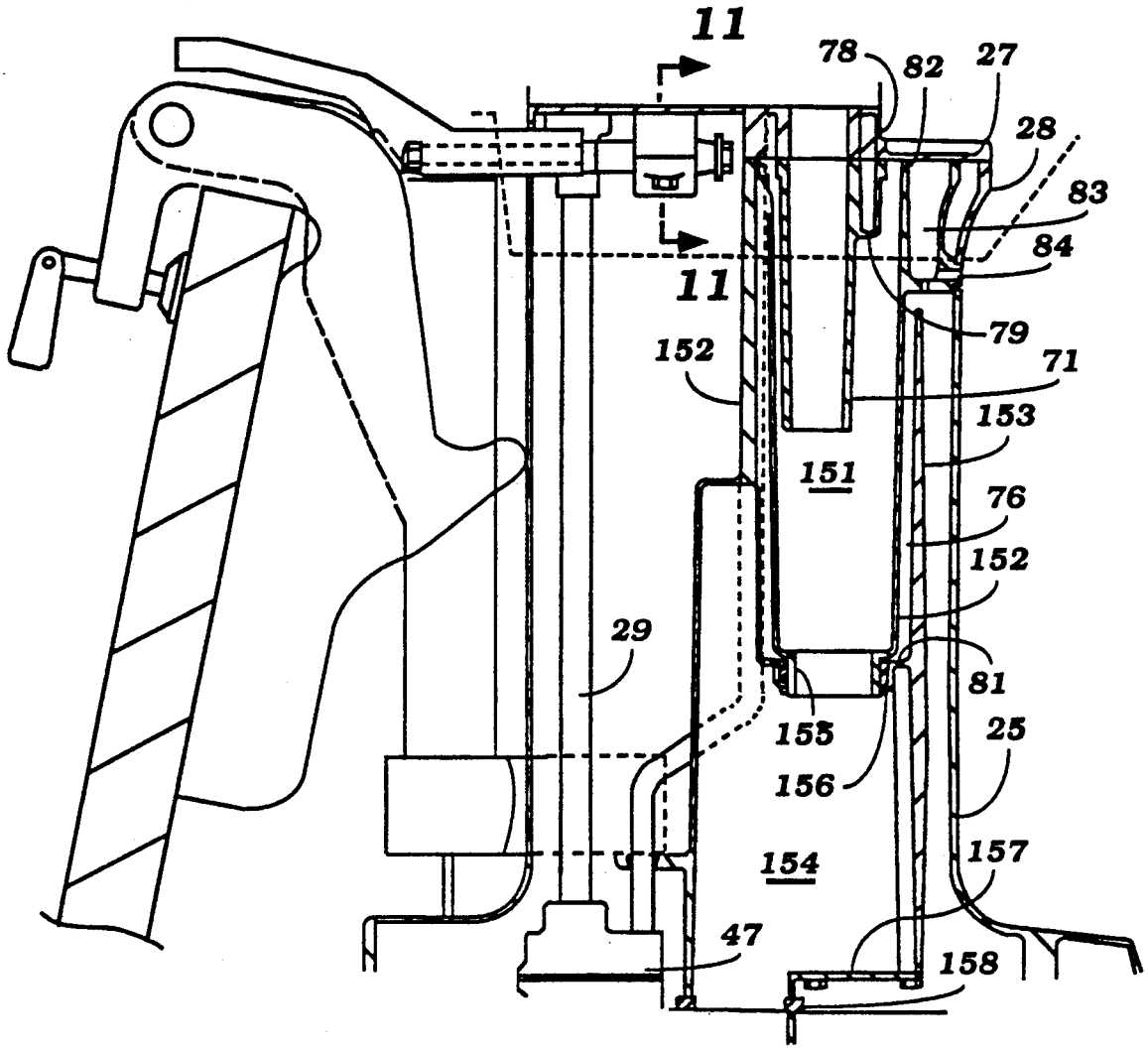
FIG. 10 is a partial side elevational view of an outboard motor constructed in accordance with another embodiment of the invention.
Figure 11:
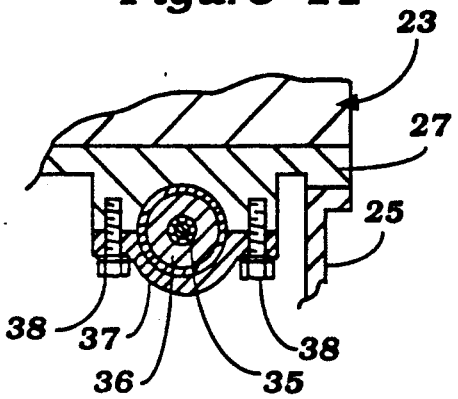
FIG. 11 is a cross sectional view taken along the line 11—11 of FIG. 10.

In the embodiment as thus far described, the location of the lubricant tank in the power head of the outboard motor rather than in the driveshaft housing or lower unit has, as has been noted, permitted the use of a large expansion chamber. This construction of the lubricating system also permits the use of plural expansion chambers in the driveshaft housing. FIGS. 10 and 11 show such an embodiment. Because the power head construction and lower unit of this embodiment are the same as that previously described, those components have not been illustrated and other components which are the same as the previously described embodiment have been identified by the same reference numerals. In this embodiment, also the connection of the steering shaft 34 to the drive shaft housing is slightly different as shown in FIG. 11. That is, the saddle clamp 37 in this embodiment is inverted and is connected to the spacer plate 27 rather than directly to the drive shaft housing 12.

Referring now in detail to FIG. 10, it should be noted that the lower spacer plate 28 is extended and the exhaust pipe 71 extends more deeply into an expansion chamber 151 formed by an extending section 152 of the lower spacer plate 28. This expansion chamber 151 extends into a further expansion chamber formed by an inner wall 153 of the drive shaft housing 25 which expansion chamber is identified by the reference numeral 154. The lower portion of the expansion chamber 151 is formed with a restricted neck 155 that discharges into the expansion chamber 154. An elastic seal 156 is provided in the area between these two expansion chambers.

A lower wall 157 of the expansion chamber 154 merges into the lower unit housing 31 and an elastic seal 158 prevents leakage of the exhaust gases in this area. Thus, it should be seen that the exhaust gases in this embodiment will be further silenced because they undergo two expansions before discharge through the hub exhaust 75. In all other regards, as has been noted, this embodiment is the same as that previously described. For that reason, further description is believed to be unnecessary.

Figure 12:
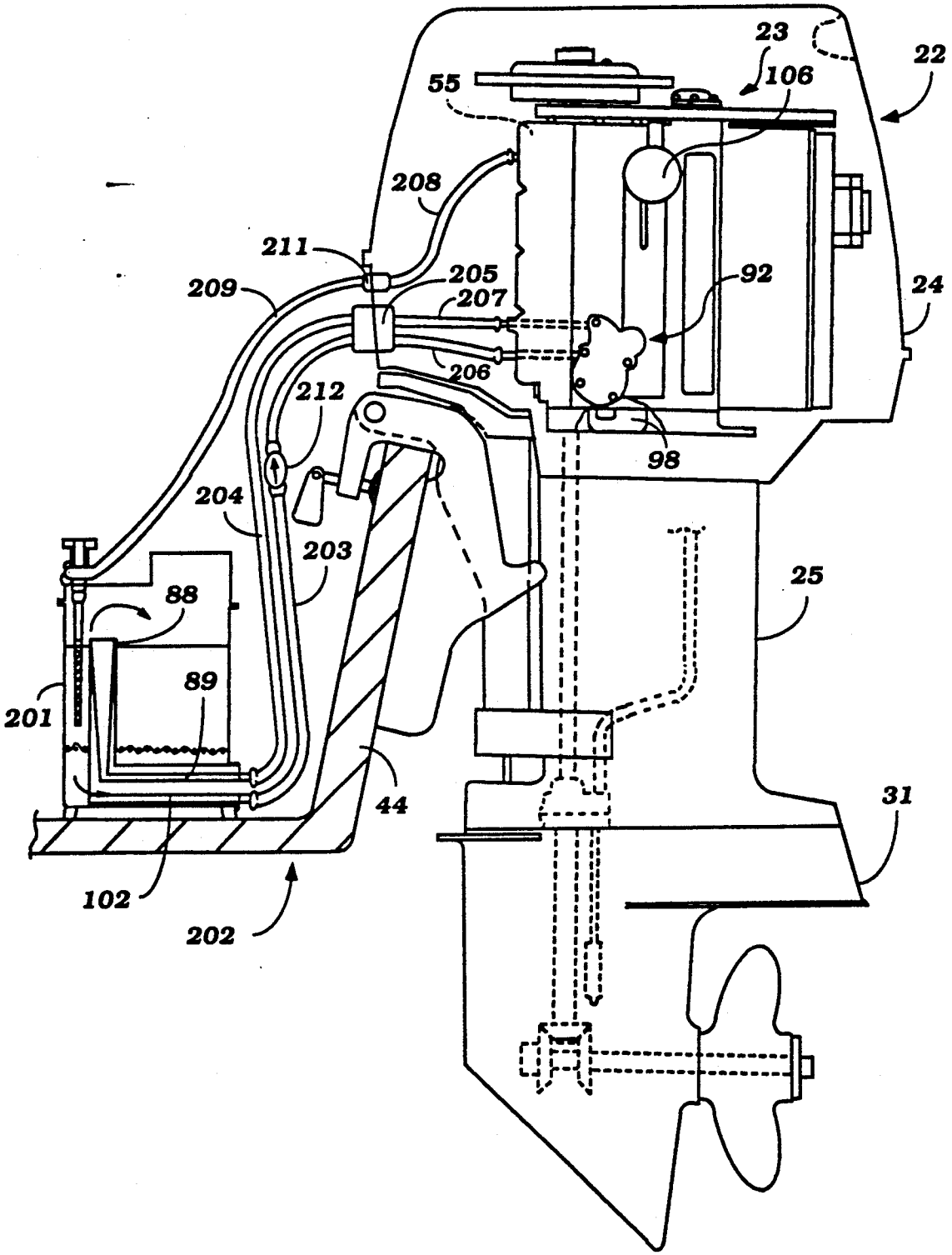
FIG. 12 is a side elevational view of an outboard motor and a portion of an associated watercraft, with parts shown in cross section, of yet another embodiment of the invention.

In the embodiments of the invention as thus far described, the oil reservoir 85 has been positioned within the power head of the engine. FIG. 12 shows another embodiment of the invention, which is generally the same as either the embodiments of FIGS. 1 through 9 or 10 and 11 but in which the oil reservoir is positioned externally of the power head but still not in the drive shaft housing. Because of this similarity, components which are the same as those previously described have been identified by the same reference numerals and will be described again only insofar as is necessary to understand the construction and operation of this embodiment.

In this embodiment, an oil reservoir 201 is positioned within the hull 202 of the watercraft forwardly of its transom 44. The oil reservoir 34 has the same construction as previously described including the provision of the stand pipe 88 and the oil passages previously described which extend through it. These oil passages are interconnected with the pump assembly 92 by a supply line 203 and a return line 204 which have a common quick disconnect coupling 205 to corresponding conduit portions 206 and 207 contained within the protective cowling 24.

In addition, a vent pipe 208 extends from the crankcase 55 to a vent conduit 209 of the tank 201. A further quick connect coupling 211 connects these two conduit sections. Of course, the vent pipes and delivery and return pipes 203 and 204 may all be contained within a common bundle that shares a single coupling with the power head 22. A manual priming pump 212 is provided in the supply line 203 due to the spacing between the oil tank 21 and the engine 23 in this embodiment.

It should be readily apparent from the foregoing description that the embodiments of the invention described provide a very effective lubricating system for a four cycle engine that has a large lubricant capacity but, at the same time, permits the use of a large expansion chamber or multiple expansion chambers in the drive shaft housing. As a result, both the lubricating system and the exhaust system may be designed to be optimized without any adverse effects of one on the other.

It is also to be understood that the foregoing description is that of preferred embodiments of the invention. Various changes and modifications may be made without departing from the spirit and scope of the invention, as defined by the appended claims.

I claim:

1. An outboard motor comprised of a power head including an internal combustion engine and a surrounding protective cowling, a drive shaft housing and lower unit depending from said power head and affixed thereto, a drive shaft driven by said internal combustion engine and journaled in said drive shaft housing and lower unit, and a propulsion unit in said lower unit driven by said drive shaft, the improvement comprising said internal combustion engine operating on a four stroke cycle and having a lubricating system, a lubricant reservoir contained externally of said engine and externally of said drive shaft housing and lower unit, means including a pressure pump for circulating lubricant from said lubricant reservoir to said engine lubricating system, a scavenge pump for returning lubricant from said engine lubricating system to said lubricant reservoir, and vent conduit means communicate said engine lubricating system with said lubricant reservoir at points above the lubricant level in both said lubricating system and said lubricant reservoir.

2. An outboard motor as set forth in claim 1 wherein the means for circulating lubricant between the lubricant reservoir and the engine lubricating system comprises a supply conduit for delivering lubricant pumped by the pressure pump from the reservoir to the engine lubricating system and a return conduit for returning the lubricant pumped from the lubricating system by the scavenge pump to the lubricant reservoir.

3. An outboard motor as set forth in claim 2 wherein the engine has a crankshaft rotatably journaled within a crankcase and the lubricant reservoir is positioned externally of the crankcase.

4. An outboard motor as set forth in claim 3 wherein the engine crankshaft rotates about a vertically extending axis.

5. An outboard motor as set forth in claim 4 wherein the lubricant reservoir is contained within the protective cowling of the power head but externally of the internal combustion engine.

6. An outboard motor as set forth in claim 4 wherein the lubricant reservoir is positioned externally of the outboard motor.

7. An outboard motor as set forth in claim 1 wherein the lubricant reservoir is positioned within the protective cowling of the power head but externally of the internal combustion engine.

8. An outboard motor as set forth in claim 1 wherein the lubricant reservoir is positioned externally of the outboard motor.

9. An outboard motor as set forth in claim 1 further including an exhaust expansion chamber formed within the drive shaft housing and lower unit and receiving exhaust gases from the engine.

10. An outboard motor as set forth in claim 9 wherein the means for circulating lubricant between the lubricant reservoir and the engine lubricating system comprises a supply conduit for delivering lubricant pumped by the pressure pump from the reservoir to the engine lubricating system and a return conduit for returning the lubricant pumped by the scavenge pump from the lubricating system to the lubricant reservoir.

11. An outboard motor as set forth in claim 10 wherein the engine has a crankshaft rotatably journaled within a crankcase and the lubricant reservoir is positioned externally of the crankcase.

12. An outboard motor as set forth in claim 11 wherein the engine crankshaft rotates about a vertically extending axis.

13. An outboard motor as set forth in claim 12 wherein the lubricant reservoir is contained within the protective cowling of the power head but externally of the internal combustion engine.

14. An outboard motor as set forth in claim 12 wherein the lubricant reservoir is positioned externally of the outboard motor.

15. An outboard motor as set forth in claim 9 wherein the lubricant reservoir is contained within the protective cowling of the power head but externally of the internal combustion engine.

16. An outboard motor as set forth in claim 9 wherein the lubricant reservoir is positioned externally of the outboard motor.

17. An outboard motor as set forth in claim 5 wherein the vent conduit is positioned above the lubricant level in the lubricant reservoir and the lubricating system when the outboard motor is affixed to a transom of the watercraft and also when the outboard motor is removed from a watercraft and is laid on its side.

18. An outboard motor as set forth in claim 7 wherein the vent conduit is positioned above the lubricant level in the lubricant reservoir and the lubricating system when the outboard motor is affixed to a transom of the watercraft and also when the outboard motor is removed from a watercraft and is laid on its side.

19. An outboard motor as set forth in claim 13 wherein the vent conduit is positioned above the lubricant level in the lubricant reservoir and the lubricating system when the outboard motor is affixed to a transom of the watercraft and also when the outboard motor is removed from a watercraft and is laid on its side.

* * * * *

UNITED STATES PATENT AND TRADEMARK OFFICE

CERTIFICATE OF CORRECTION

PATENT NO. : 5,037,340

DATED : August 6, 1991

INVENTOR(S) : Yasuhiko Shibata

It is certified that error appears in the above-identified patent and that said Letters Patent is hereby corrected as shown below:

Column 8, line 40, Claim 7, "positioned" should be --contained--.

Signed and Sealed this

Twentieth Day of July, 1993

*Attest:*

Michael K. Kirk

MICHAEL K. KIRK

*Attesting Officer*

*Acting Commissioner of Patents and Trademarks*